US006068577A

United States Patent [19]

Lo

[11] Patent Number: 6,068,577

[45] Date of Patent: May 30, 2000

[54] JUMP EXERCISER

[76] Inventor: Chiu-Hsiang Lo, No. 20 Lane 305, Sec. 3, Chung-Shan Road, Tan-Tz Hsiang, Taichung Hsien, Taiwan

[21] Appl. No.: 09/401,544

[22] Filed: Sep. 22, 1999

[51] Int. Cl.[7] ..... A63B 22/04

[52] U.S. Cl. ..... 482/52; 482/146

[58] Field of Search ..... 482/51, 52, 53, 482/70, 71, 79, 80, 146, 147

[56] References Cited

U.S. PATENT DOCUMENTS 5,004,224 4/1991 Wang ..... 482/53
5,304,106 4/1994 Gresko ..... 482/53
5,320,588 6/1994 Wanzer et al. ..... 482/53
5,527,253 6/1996 Wilkinson et al. ..... 482/147
5,632,711 5/1997 Hwang ..... 482/147

*Primary Examiner*—Stephen R. Crow
*Attorney, Agent, or Firm*—Rosenberg, Klein & Lee

[57] ABSTRACT

A jump exerciser includes a base having a mounting portion. A swivel seat includes a first end pivotally connected to the mounting portion. A footboard is rotatably mounted to the second end of the swivel seat. An elastic device has a first end pivotally connected to a mediate portion of the swivel seat and a second end pivotally connected to the mounting portion. A latch is provided to retain the footboard in place during jumping exercise. The latch is released to allow the user to stand on the footboard and twist his/her waist.

5 Claims, 7 Drawing Sheets

JUMP EXERCISER

BACKGROUND OF THE INVENTION

1. Field of the Invention

The present invention relates to a jump exerciser that allows the user to exercise by jumping.

2. Description of the Related Art

Indoor exercisers become more and more popular in modern world, e.g., walking type exercisers, hiking type exercisers, horse-riding type exercisers, etc. Different types of exercisers allow the user to exercise different body portions and muscles. The present invention is intended to provide a jump exerciser that allows the user to exercise by jumping.

SUMMARY OF THE INVENTION

A jump exerciser in accordance with the present invention comprises:

a base including a mounting portion;

a swivel seat including a first end pivotally connected to the mounting portion, a second end, and a mediate portion;

a footboard mounted to the second end of the swivel seat; and an elastic means having a first end pivotally connected to the mediate portion of the swivel seat and a second end pivotally connected to the mounting portion.

Two support rods extend upward from the mounting portion and two handles are secured to the support rods, respectively.

The footboard is rotatably mounted to the second end of the swivel seat. A latch means has a catch with a hook for releasably engaging with a hole in the footboard to prevent rotation of the footboard. The second end of the swivel seat is hollow. A tubular member is received in the second end of the swivel seat and includes a longitudinal hole with a shoulder formed therein. The latch means includes a stem that is integral with the catch and slidably extended through the longitudinal hole of the tubular member. A nut is threadedly engaged with an end of the stem located in the tubular member. A spring is mounted in the longitudinal hole of the tubular member and attached between the nut and the shoulder. A knob is attached to the other end of the stem for manual operation. The second end of the swivel seat includes a notch in an end face thereof for releasably engaging with the catch.

The base further includes a pair of spaced connecting plates with a plurality of pairs of aligned holes for selectively engaging with the second end of the elastic means.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
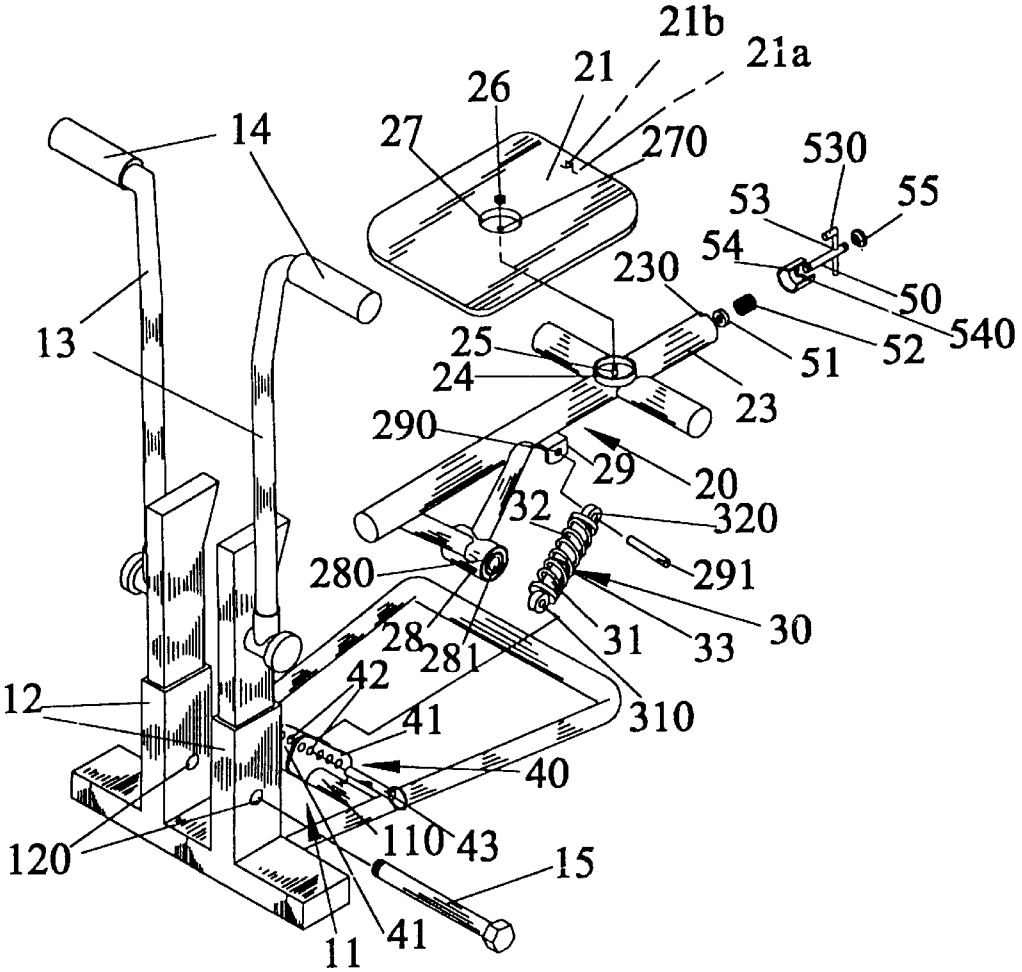
FIG. 1 is an exploded perspective view of a jump exerciser in accordance with the present invention.
Figure 2:
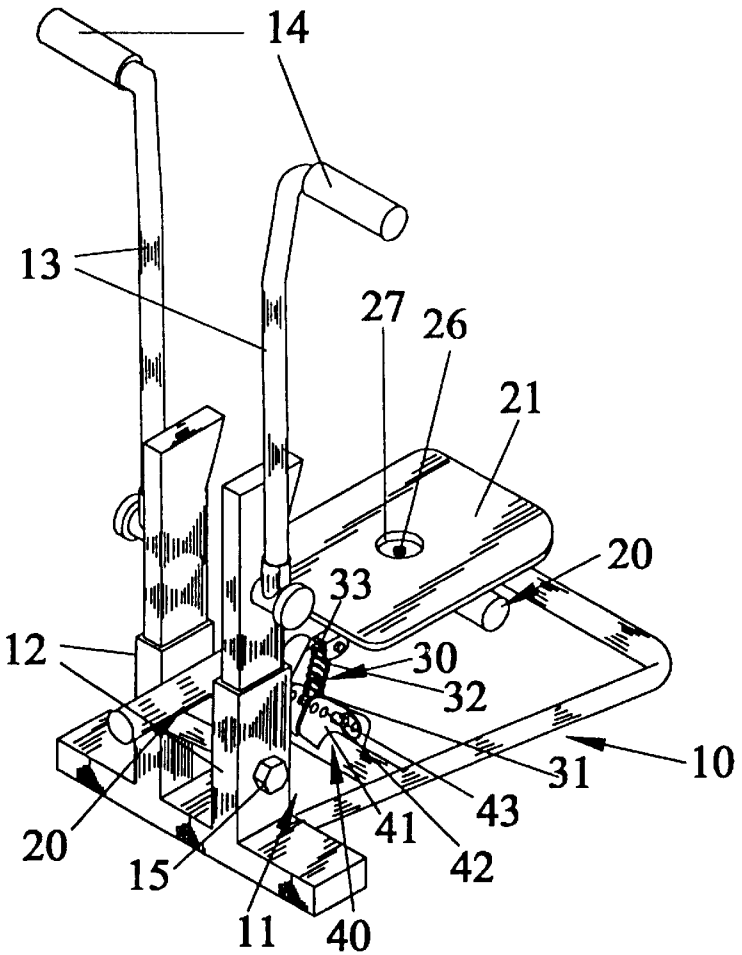
FIG. 2 is a perspective view of the jump exerciser in accordance with the present invention.

Referring to FIGS. 1 and 2, a jump exerciser in accordance with the present invention generally includes a base 10 with a mounting portion 11. In this embodiment, the mounting portion 11 includes two columns 12 from which two support rods 13 extend, respectively. Each support rod 13 has a handle 14 attached thereto for user's grasp. The base 10 further includes two supports 110 extended from two lateral sides thereof, respectively. A connecting plate 41 is secured to each support 111 and includes a number of holes 42, which will be described later.

A swivel seat 20 (in the form of a cruciform member) includes a first end with a substantially V-shape extension (not labeled) extended downwardly from the first end of the swivel seat 20 and including a hub 28 with a bearing 280 therein. The hub 28 is located between the columns 12 and pivotally connected to the mounting portion 11 by means of extending a pivotal pin 15 through an axial hole 281 of the bearing 280 and aligned pin holes 120 of the columns 12. A bracket 29 is formed on a mediate portion of the swivel seat 20. A first end 32 of an elastic means 30 is pivotally connected to the bracket 29 by means of extending a pin 291 through a pin hole 320 in the first end (not labeled) of the shock-absorbing means and a pin hole 290 in the bracket 29.

A second end (not labeled) of the elastic means 30 is pivotally connected between the connecting plates 41 by means of extending a pin 43 through a pin hole 310 in the second end of the elastic means 30 and a pair of aligned holes 42 in the connecting plates 41. More specifically, the elastic means 30 includes an upper link 32 having an upper end (first end) pivotally connected to the bracket 29. The elastic means 30 further includes a lower link 31 that has a lower end (second end) 310 pivotally connected between the connecting plates 41. The upper link 32 and the lower link 31 are assembled in a telescopic manner, and a spring 33 is mounted around the links 31 and 32.

Figure 3:
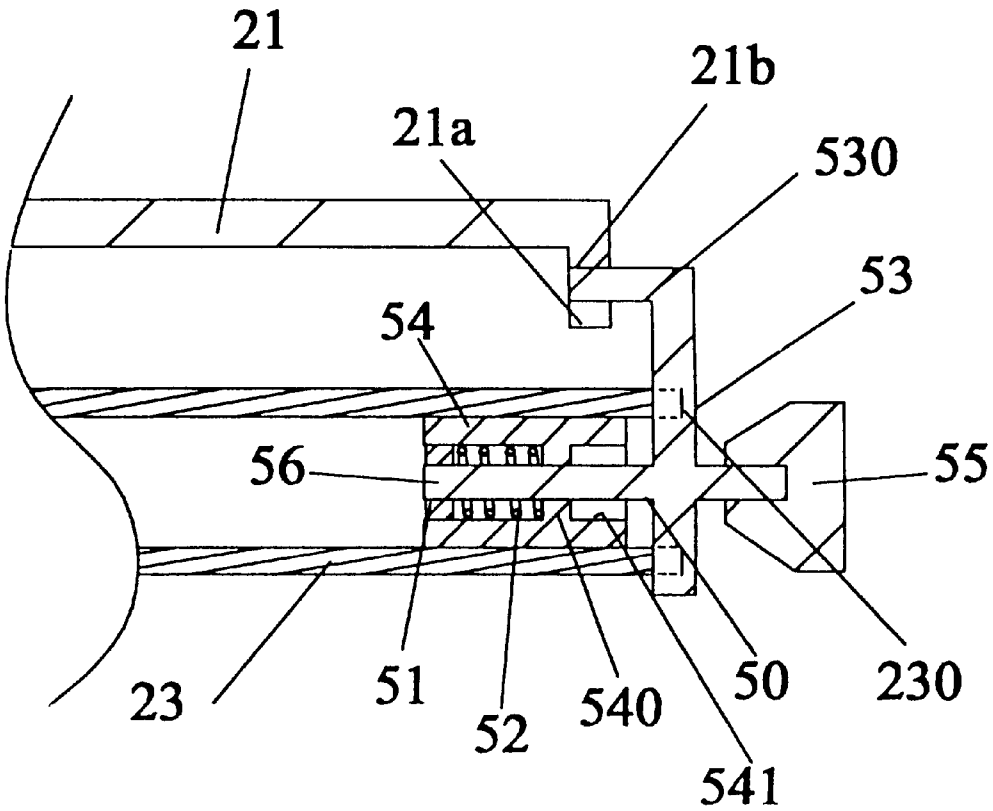
FIG. 3 is an enlarged schematic view illustrating a footboard retained in a locked status by a latch means.

A second end 23 of the swivel seat 20 includes a footboard 21 rotatably mounted thereto. In this embodiment, the swivel seat 20 includes a bowl-like member 24 having a stud 25 formed therein, and the footboard 21 includes a protrusion 27 extended downward so as to be rotatably engaged in the bowl-like member 24. The protrusion 27 includes a hole 270 through which the stud 25 extends, and a nut 26 is then threadedly engaged with the stud 25. Referring to FIG. 3, the second end 23 of the swivel seat 20 further includes a notch 230 defined in an end face thereof. The footboard 21 includes a hole 21*b* formed in a downward extension 21 a thereof.

A latch means 50 includes a catch 53 with a hook 530 releasably engaged in the hole 21*b* of the footboard 21. The catch 53 is releasably engaged in the notch 230 of the second end of the swivel seat 20. In addition, the second end 23 of the swivel seat 20 is preferably hollow for securely receiving a tubular member 54 therein. The tubular member 54 includes a longitudinal hole 541 with a shoulder 540 formed therein. The latch means 50 includes a stem that is integral with the catch 53 and slidably extended through the longitudinal hole 541. A nut 51 is threadedly engaged with a distal end of the stem 56. A spring 52 is mounted in the longitudinal hole 541 and attached between the nut 51 and the shoulder 540. A knob 55 is attached to an outer end of the stem 56 to move therewith.

Figure 4:
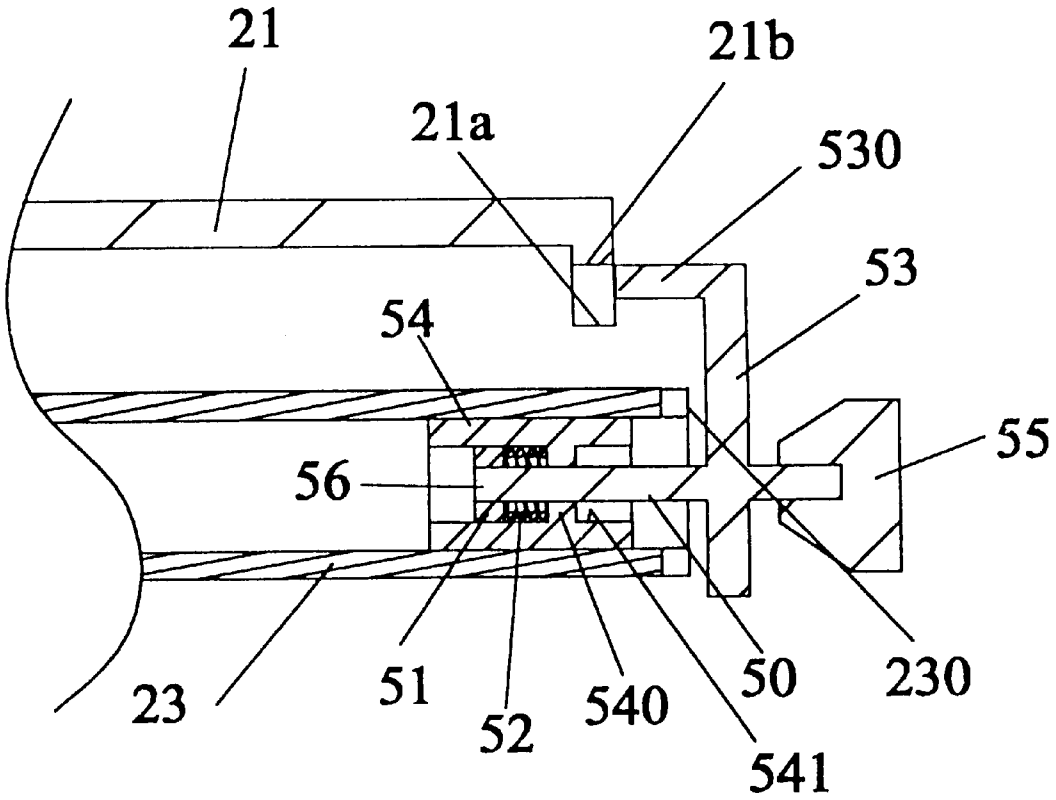
FIG. 4 is a view similar to FIG. 3, wherein the latch means is disengaged from the footboard, thereby allowing free rotation of the footboard.
Figure 5:
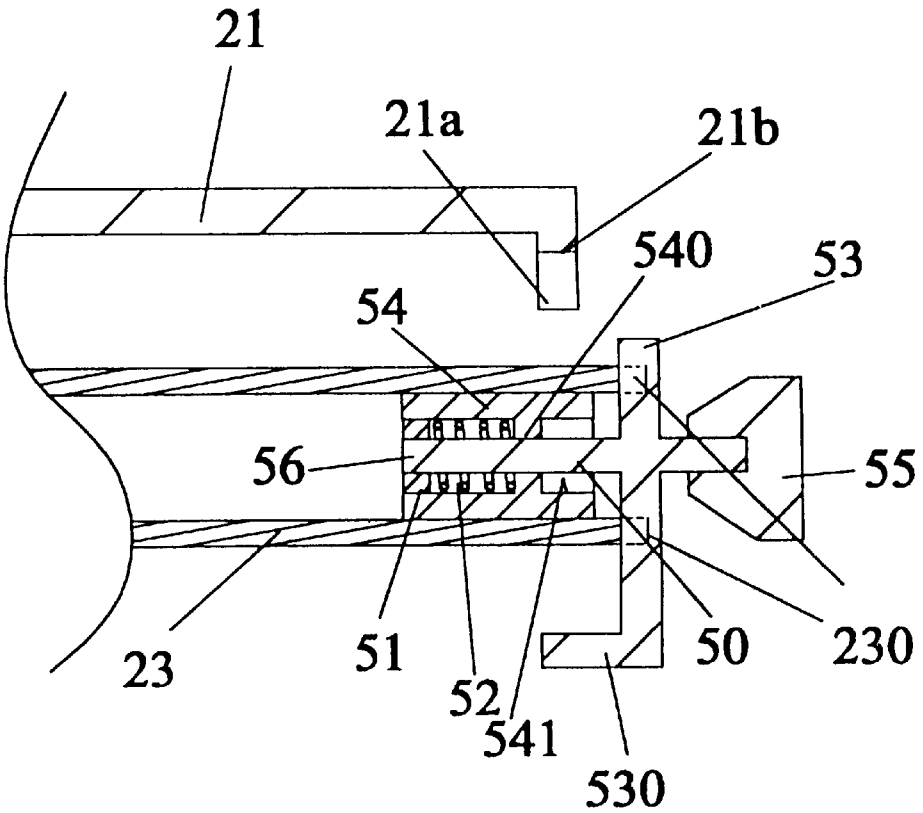
FIG. 5 is a view similar to FIG. 4, wherein the latch means is retained in place.

The footboard 21 in FIG. 3 is not rotatable, as the hook 530 of the catch 53 is engaged in the hole 21*a* of the footboard 21 and the catch 53 is engaged in the notch 230. The user may pull the knob 55 outward to disengage the hook 530 from the hole 21*a* and to disengage the catch 53 from the notch 230, as shown in FIG. 4. Next, the knob 55 is rotated through 1800 and then released. The hook 530 of the catch 53 is not engaged in the hole 21*b* of the footboard 21 yet the catch 53 is re-engaged in the notch 230 under the action of the spring 52. Thus, the latch means 50 is retained in place, and the footboard 21 is freely rotatable.

Figure 6:
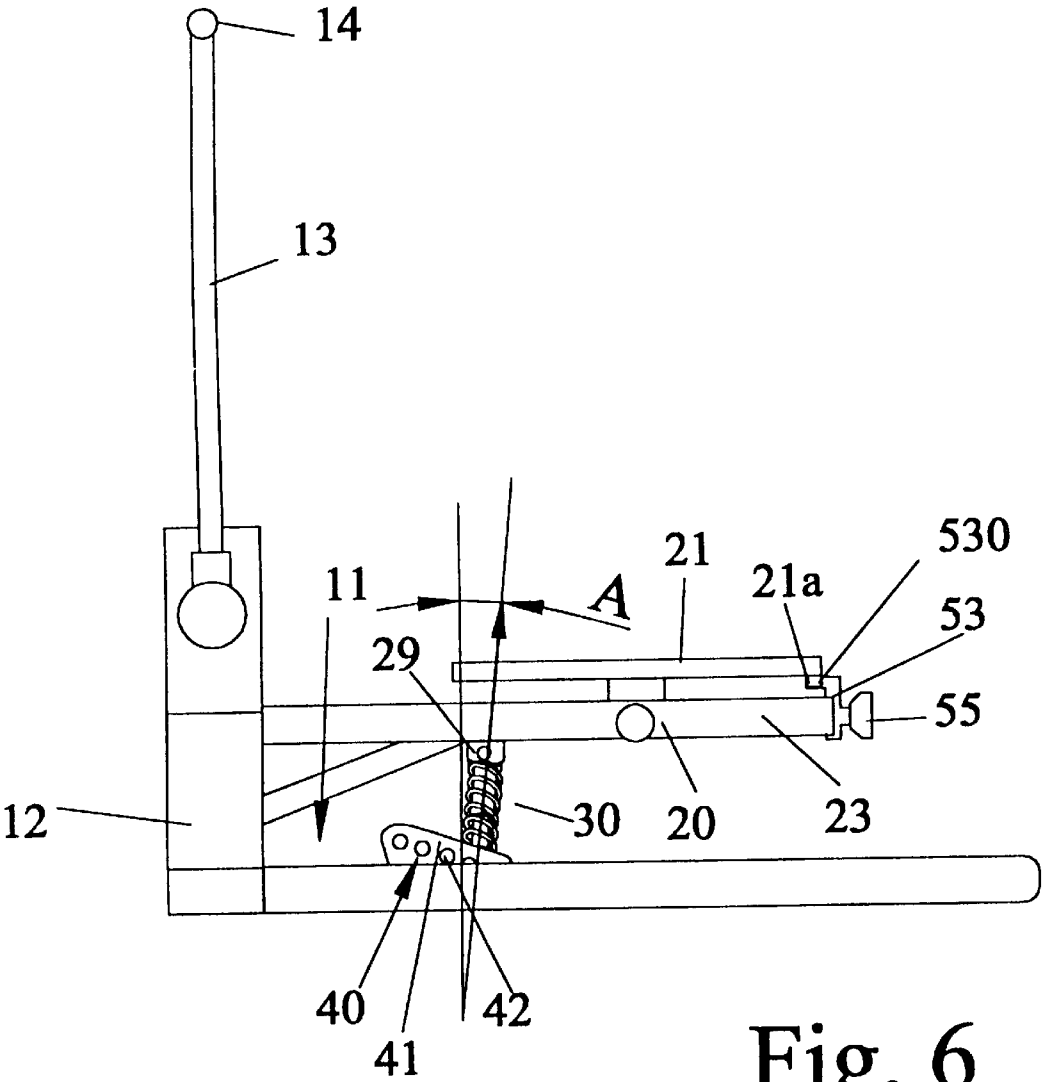
FIG. 6 is a side view of the jump exerciser in accordance with the present invention.
Figure 7:
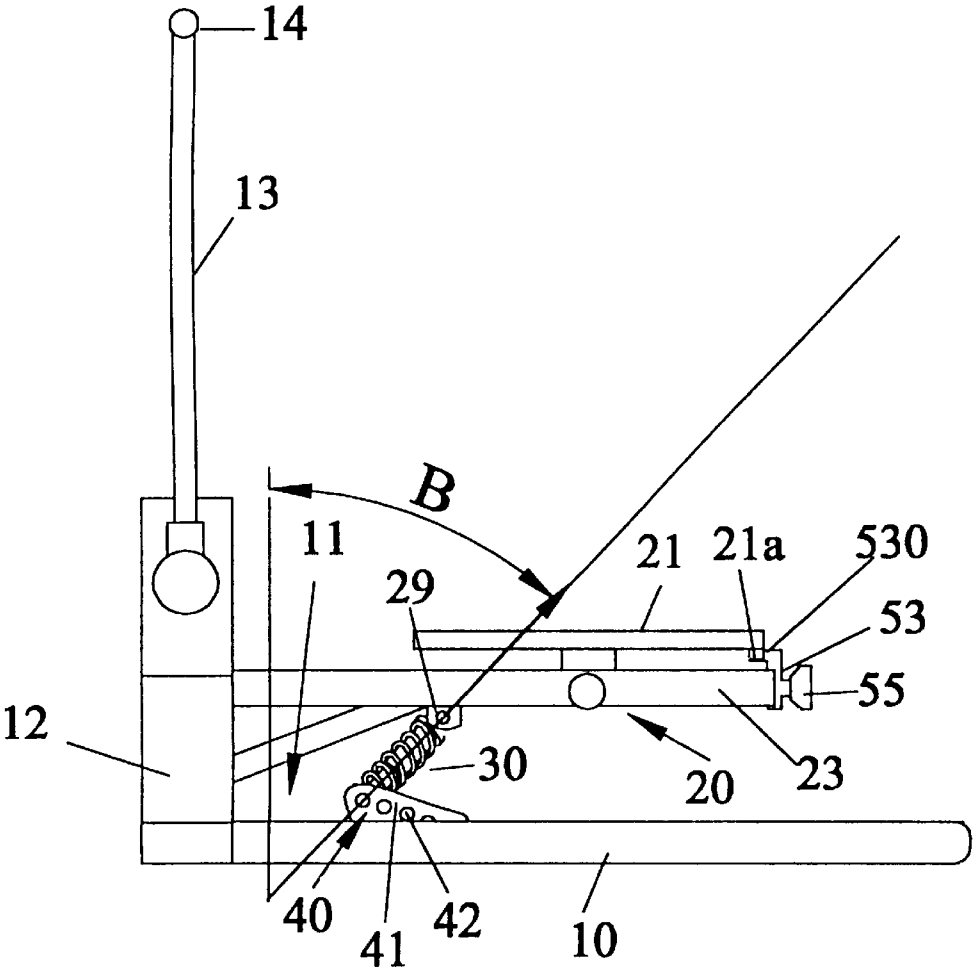
FIG. 7 is a side view similar to FIG. 6, wherein the shock-absorbing means is arranged in a different angular position.

Referring to FIG. 6, when the footboard 21 is retained in place, the user may stand on the footboard 21 and jump with two hands grasping the handles 14. The spring 33 assists in jumping ability for the user. In addition to the jumping exercise, the tie rod 22 may be removed to allow rotation of the footboard 21. Thus, the user may stand on the footboard 21 and twist his/her waist. Referring to FIG. 7, the lower end of the elastic means 30 is attached to different holes 42 of the connecting plates 41 to provide smaller reactive force to the footboard 21. As illustrated in FIG. 7, the elastic means 30 extends at an angle B (rather than A in FIG. 6) with the vertical axis.

According to the above description, it is appreciated that the jump exerciser allows the user to exercise by either jumping or waist twisting. In addition, position of the elastic means 30 may be adjusted to provide different jumping assistance.

Although the invention has been explained in relation to its preferred embodiment, it is to be understood that many other possible modifications and variations can be made without departing from the spirit and scope of the invention as hereinafter claimed.

What is claimed is:

1. A jump exerciser comprising:

a base including a mounting portion;

a swivel seat including a first end pivotally connected to the mounting portion, a hollow second end, and a mediate portion;

a footboard rotatably mounted to the second end of the swivel seat;

latch means having a catch with a hook for releasable engagement with a hole formed in the footboard to prevent rotation of the footboard; and elastic means having a first end pivotally connected to the mediate portion of the swivel seat and a second end pivotally connected to the mounting portion, said swivel seat including a tabular member receive in the second end of the swivel seat and having a longitudinal hole with a shoulder formed therein, the latch means including (a) a stem that is integral with the catch and slidably extended through the longitudinal hole of the tubular member, (b) a nut threadedly engaged with an end of the stem located in the tubular member, and (c) a spring mounted in the longitudinal hole of the tubular member and attached between the nut and the shoulder.

2. The jump exerciser as claimed in claim 1, further comprising two support rods extended upward from the mounting portion and two handles secured to the support rods, respectively.

3. The jump exerciser as claimed in claim 1, further comprising a knob attached to the other end of the stem for manual operation.

4. The jump exerciser as claimed in claim 1, wherein the second end of the swivel seat includes a notch in an end face thereof for releasably engaging with the catch.

5. The jump exerciser as claimed in claim 1, wherein the base further includes a pair of spaced connecting plates with a plurality of pairs of aligned holes for selectively engaging with the second end of the elastic means.

* * * * *